US009074404B2

(12) United States Patent
DeLozier et al.

(10) Patent No.: US 9,074,404 B2
(45) Date of Patent: Jul. 7, 2015

(54) HOUSEHOLD APPLIANCE HAVING SYSTEM FOR ALIGNING DOORS AND METHOD THEREOF

(75) Inventors: Ryan DeLozier, Knoxville, TN (US); Samuel Harward, Knoxville, TN (US); Rose Marie Parker, Caryville, TN (US)

(73) Assignee: BSH Home Applicances Corporation, Irvine, CA (US)

( * ) Notice: Subject to any disclaimer, the term of this patent is extended or adjusted under 35 U.S.C. 154(b) by 0 days.

(21) Appl. No.: 13/483,392

(22) Filed: May 30, 2012

(65) Prior Publication Data

US 2013/0318874 A1 Dec. 5, 2013

(51) Int. Cl.

| | |
|---|---|
| ***A47B 49/00*** | (2006.01) |
| ***E06B 5/00*** | (2006.01) |
| ***F24C 15/00*** | (2006.01) |
| *A47B 88/00* | (2006.01) |

(52) U.S. Cl.

CPC ..... *E06B 5/00* (2013.01); *A47B 88/0055* (2013.01); *F24C 15/00* (2013.01)

(58) Field of Classification Search

CPC ..... E06B 5/00; E06B 3/38; A47B 88/0055; A47B 88/0051; A47B 88/0044; A47B 2210/02; E05F 5/08; F24C 15/00

USPC ..... 312/348.4, 109, 330.1; 126/39 K, 41 D, 126/9 B; 16/235–249

See application file for complete search history.

(56) References Cited

U.S. PATENT DOCUMENTS

| | | | | | |
|---|---|---|---|---|---|
| 1,948,118 | A | * | 2/1934 | Klemme | 126/340 |
| 1,960,365 | A | * | 5/1934 | Barker | 312/400 |
| 2,027,124 | A | * | 1/1936 | Stockstrom et al. | 126/41 D |
| 2,028,636 | A | * | 1/1936 | Wilkinson et al. | 126/39 K |
| 2,327,761 | A | * | 8/1943 | Brodbeck | 312/334.15 |
| 2,520,816 | A | * | 8/1950 | Sherman | 126/41 D |
| 2,552,373 | A | | 5/1951 | Hardwick | |
| 2,632,434 | A | * | 3/1953 | Pearce | 126/1 R |
| 2,775,501 | A | * | 12/1956 | Kyllo | 312/348.4 |
| 3,092,097 | A | * | 6/1963 | Moss | 126/194 |
| 3,132,640 | A | | 5/1964 | Chisholm et al. | |
| 3,325,942 | A | * | 6/1967 | Bejarano | 49/381 |
| 4,021,968 | A | * | 5/1977 | Kendall | 49/386 |
| 4,163,344 | A | * | 8/1979 | Scherer | 49/386 |
| 4,665,892 | A | * | 5/1987 | Spargo et al. | 126/194 |
| 5,002,346 | A | * | 3/1991 | Gasser | 312/348.4 |
| 5,058,236 | A | | 10/1991 | Henson | |

(Continued)

OTHER PUBLICATIONS

The Range cooker Collection 2010 Brochure by Belling, 2010.*

*Primary Examiner* — Daniel J Troy
*Assistant Examiner* — Timothy M Ayres
(74) *Attorney, Agent, or Firm* — James E. Howard; Andre Pallapies

(57) ABSTRACT

A household appliance including a non-adjustable first door, an adjustable second door, and an adjustable third door. The non-adjustable first door provides a reference point for adjusting each of the second door and the third door. A first adjustment device adjusts the second door in a vertical direction until one of a handle and a top edge of the non-adjustable first door and the second door are aligned at a same height. A second adjustment device adjusts the third door in a horizontal direction such that a first gap between the third door and the second door is equal to a second gap between the non-adjustable first door and the second door, and adjusts the third door in the first direction such that the third door is level and a bottom edge of the third door is aligned with a bottom edge of the second door.

25 Claims, 8 Drawing Sheets

(56) References Cited

U.S. PATENT DOCUMENTS

| | | | | |
|---|---|---|---|---|
| 5,144,721 | A | 9/1992 | Schade | |
| 5,799,370 | A | 9/1998 | Davidian et al. | |
| 6,390,576 | B1 * | 5/2002 | Walburn | 312/348.4 |
| 6,925,682 | B2 | 8/2005 | Mueller et al. | |
| 6,948,788 | B1 * | 9/2005 | Tai | 312/348.4 |
| 7,552,511 | B2 * | 6/2009 | Campbell et al. | 16/238 |
| 7,676,887 | B2 | 3/2010 | Chung | |
| 7,694,388 | B2 | 4/2010 | Campbell et al. | |
| 8,079,114 | B2 * | 12/2011 | Fries et al. | 16/243 |
| 2002/0125384 | A1 * | 9/2002 | Compagnucci | 248/200 |
| 2003/0111943 | A1 * | 6/2003 | Banicevic et al. | 312/404 |
| 2004/0222725 | A1 * | 11/2004 | Park et al. | 312/405 |
| 2005/0093407 | A1 * | 5/2005 | Feeley et al. | 312/348.4 |
| 2008/0074019 | A1 * | 3/2008 | Park et al. | 312/236 |
| 2009/0079309 | A1 * | 3/2009 | Liebsch et al. | 312/319.5 |
| 2010/0007249 | A1 * | 1/2010 | Brown et al. | 312/109 |
| 2013/0214663 | A1 * | 8/2013 | Marzorati | 312/400 |
| 2013/0291853 | A1 * | 11/2013 | Braden et al. | 126/19 R |

* cited by examiner

HOUSEHOLD APPLIANCE HAVING SYSTEM FOR ALIGNING DOORS AND METHOD THEREOF

FIELD OF THE INVENTION

The present invention is directed to a household appliance, and more particularly, to a household appliance having a system and method of aligning a plurality of household appliance doors, and more particularly, three or more doors of an appliance.

BACKGROUND OF THE INVENTION

A conventional appliance may include a plurality of doors providing access to a plurality of interiors chambers of the appliance. For example, a conventional oven/range may have multiple doors, such as an oven door, a steam and/or convection oven door, or a warming drawer door, which provide access to an interior of, for example, a cooking chamber, a steam cooking chamber, or a warming drawer, etc. A user, technician, or installer may wish to adjust the doors to align the doors for aesthetic reasons or to provide proper spacing and clearances between adjacent doors to avoid interference with the proper function of the doors. However, in some instances, each of the doors may have a different construction and may be moveable with respect to a housing of the appliance in a variety of ways, such as pivoting, sliding, etc., and thus, may have different attachment means such as hinges or slides. Each of the doors also may have handles, for example, that correspond to each other in location and shape and also may need to be aligned to provide a suitable or desired aesthetic appearance. In some instances, one or more of the doors may be adjustable, while in other instances, one or more of the doors may not be adjustable. As a result, the doors of many conventional appliances are difficult to align properly, particularly for a user, technician, or installer, and in some cases, may not be capable of being aligned with one another. In other cases, the doors of the conventional appliances may require complex and time-consuming adjustment procedures and special tools to align the doors properly.

SUMMARY OF THE INVENTION

The present invention recognizes that, in a household appliance, for example, having three or more doors, a user, technician, or installer may need to align the top edges of two or more adjacent doors, the bottom edge of two or more adjacent doors, the handles of two or more adjacent doors, as well as to position two or more adjacent doors to have a constant gap between adjacent edges of the doors.

A first exemplary embodiment of the present invention is directed to a system for aligning a plurality of doors on an appliance, such as a range/stove, in which a first non-adjustable door remains stationary or fixed, a second adjustable door is at least one-dimensionally adjustable, and a third adjustable door is at least two-dimensionally adjustable.

Another embodiment is directed to a system for aligning doors on an appliance in which a first non-adjustable door remains stationary or fixed, a second adjustable door is at least one-dimensionally adjustable, and a third adjustable door is three-dimensionally adjustable.

Yet another embodiment is directed to a system for aligning doors on an appliance in which a first non-adjustable door remains stationary or fixed, a second adjustable door is at least two-dimensionally adjustable, and a third adjustable door is three-dimensionally adjustable.

More particularly, in an example embodiment, a household appliance includes a plurality of doors, such as three or more doors (e.g., a first or main oven door; a second or steam oven door, and a third or warming drawer door). The doors can be arranged such that each door is adjacent to at least two of the other doors. For example, a main door (e.g., main oven door) may be larger than the other two secondary doors (e.g., steam oven door and warming drawer door) such that a single edge of the main door is adjacent to an edge of each of the secondary doors. In this example, the appliance may include a main door and two smaller doors disposed alongside the main door, with the smaller doors aligned one on top of the other. However, other arrangements are contemplated by the present invention.

A first door (in this example, a steam oven door) can be configured to be a non-adjustable door such that the first door remains fixed or stationary and cannot be adjusted to align the door with other doors. For purposes of this disclosure, "non-adjustable" means that, when the door is closed (i.e., when the door is covering the chamber of the appliance), an up or down position, side-to-side position, forward or backward position, or angular position of the door cannot be adjusted or altered from the current position of the door without modifying, replacing, removing, or adding parts. The exemplary embodiments use the first non-adjustable door as a reference point for adjusting the additional doors of the appliance.

A second door (in this example, the main oven door) can be configured to be adjustable up or down to align with the first door (e.g., a steam oven door). A third door (in this example, a warming drawer door) can be adjusted up and down, side-to-side, and angled to align with both the first door (e.g., steam oven door) and the second door (e.g., a main oven door). The exemplary embodiment provide a simple and convenient means for ensuring that all doors (e.g., all three doors) can be aligned/adjusted with even spacing and no interference to each other or to other parts of the range or cabinetry.

In an embodiment, the second door (e.g., a main oven door) can include an adjustable hinge receiver for adjusting the door up and down to align with the first door (e.g., a steam oven door). Conventional hinge receivers may be adjustable by turning an adjustment screw located under the hinge. In contrast, the exemplary embodiment includes an inverted adjustable hinge receiver in which the adjustment screw is disposed above the hinge to provide simple and easy access and adjustment of the second door.

Particularly, an exemplary embodiment uses the first, non-adjustable door (e.g., steam oven door) as a fixed reference point. The second door (e.g., main oven door) may be disposed a fixed horizontal distance from the first door (e.g., steam door), but may be adjusted up and down so that the handle and top edge of both doors are at the same height. The third door (e.g., warming drawer door) can use screws with fender washers to hold or maintain the horizontal and vertical position in oversized holes relative to its mounting plate. The third door is adjusted such that the horizontal gap between the third door and the second door is the same as the gap between the second door and the first door. The third door is then adjusted vertically such that the third door is level and such that a bottom edge of the third door is at the same height as the bottom edge of the second door. The angle of the mounting plate of the third door can be adjusted in order to bring a front face of the third door out flush with the first door and the second door.

An exemplary embodiment is directed to a system for aligning a plurality of doors of a household appliance, the system includes a housing having a first chamber, a second chamber, and a third chamber. Each of the first chamber, the second chamber, and the third chamber has an access opening formed in a front wall of the housing of the household appliance. The system can include a first door covering a first opening of the first chamber, the first door being fixed in a vertical direction, a horizontal direction, and in a direction that is perpendicular to the vertical direction and the horizontal direction with respect to the front wall of the housing. The system can include a second door covering a second opening of the second chamber, the second door being fixed in a horizontal direction with respect to the housing, but adjustable in a vertical direction. The system further can include a third door covering a third opening of the third chamber, the third door being adjustable in a vertical and horizontal direction with respect to a front of the housing, as well as toward and away from the front wall of the housing of the household appliance.

The exemplary embodiments can provide a system for, and method of, adjusting a plurality of doors to ensure that all of the doors can be arranged to fit properly relative to one-another. The exemplary embodiments can minimize installation and adjustment time for a user or installer, for example, by minimizing or eliminating unnecessary adjustments that may increase cost and time. The exemplary embodiments can provide a system and method that allows adjustment of all of the doors without special tools and/or without having to remove other components of the appliance.

Other features and advantages of the present invention will become apparent to those skilled in the art upon review of the following detailed description and drawings.

BRIEF DESCRIPTION OF THE DRAWINGS

These and other aspects and features of embodiments of the present invention will be better understood after a reading of the following detailed description, together with the attached drawings, wherein.

DETAILED DESCRIPTION OF THE EXEMPLARY EMBODIMENTS OF THE INVENTION

Figure 1A:
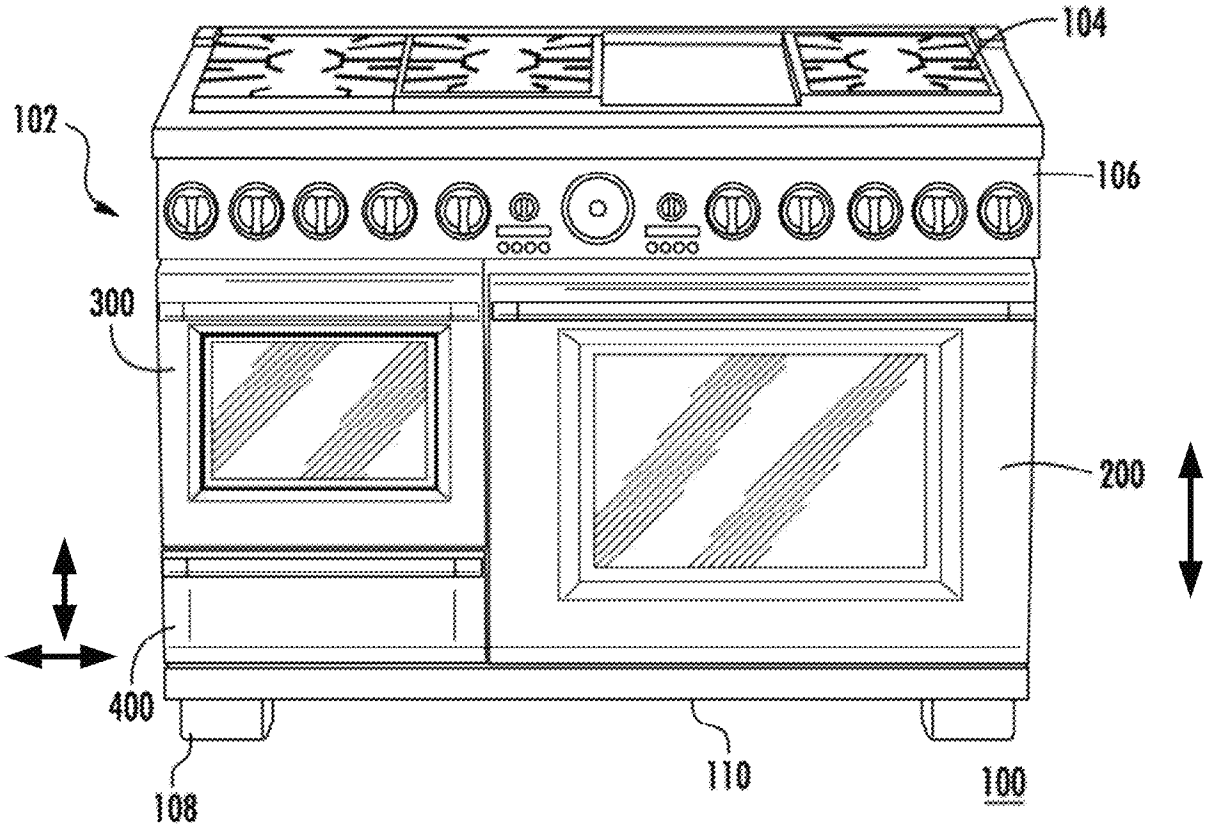
FIG. 1A-1C are a front view, side view, and perspective view of a household appliance according to an exemplary embodiment of the invention.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Referring now to the drawings, FIGS. 1-7 illustrate exemplary embodiments of a household appliance having a system for and method of aligning three or more appliance doors will now be described.

Figure 1B:
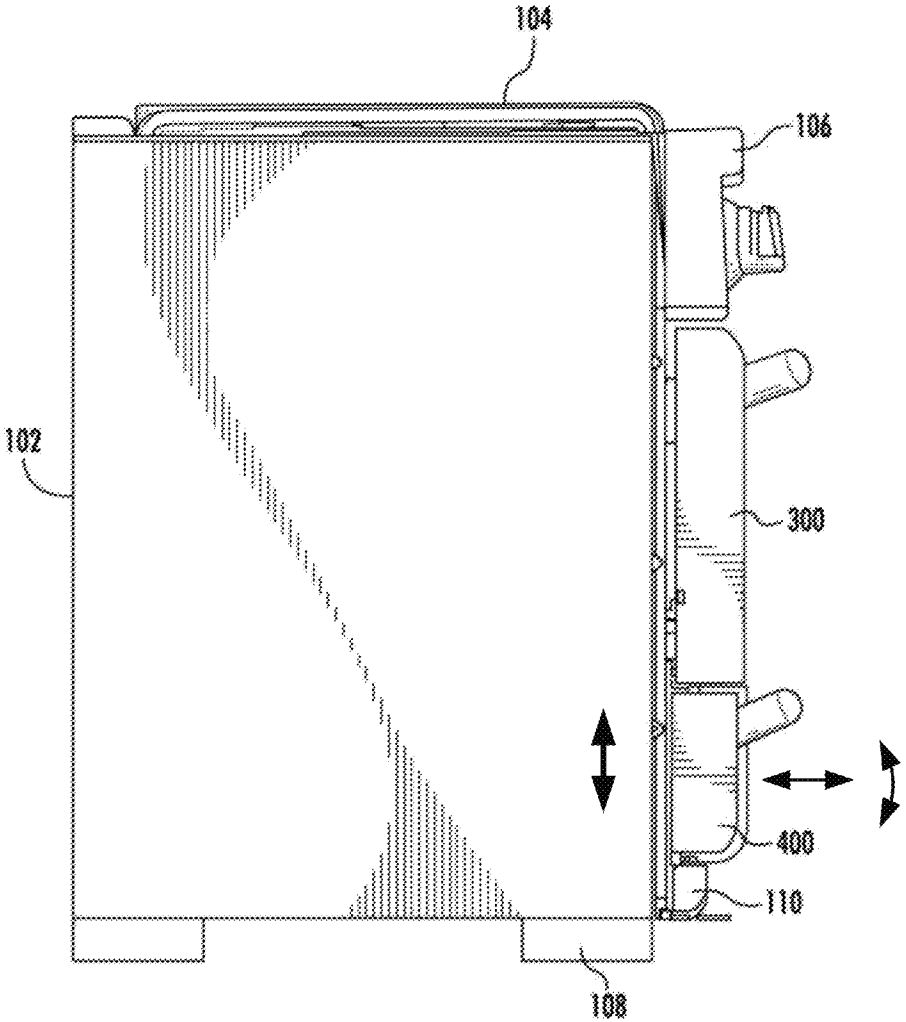
Figure 1C:
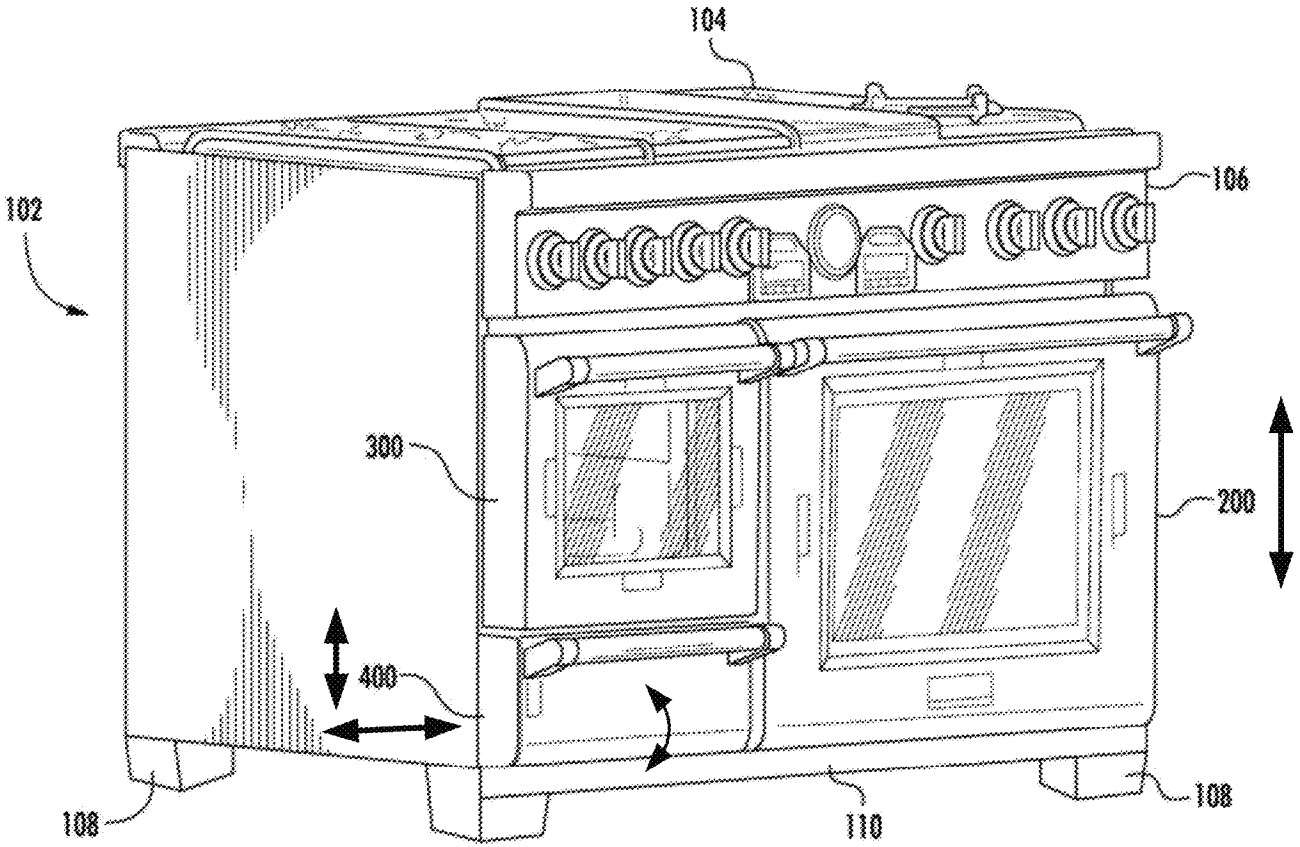

With reference to FIGS. 1A-1C, a household cooking appliance can include, for example, a gas range 100. In other embodiments, the household appliance can include a standalone oven, wall oven, or the like. In the example cooking appliances illustrated in FIGS. 1A-1C, a plurality of gas burners may be disposed on an upper surface 104 of the cooking appliance 100. A control panel 106 may be disposed, for example, on a front surface or an upper surface of the cooking appliance. The control panel 106 may include a plurality of control knobs for controlling the individual gas burners. The exemplary appliances 100 may include three or more doors, such as an oven door 200, a steam and/or convection oven door 300, a warming drawer door 400, which provide access to an interior of, for example, a cooking chamber, steam cooking chamber, warming drawer, etc. The household appliance 100 can include sidewalls 102, support pedestals or feet 108, and a kick panel 110. In other embodiments, the household appliance can be a wall-mounted appliance or built-in appliance.

With reference again to FIGS. 1A-1C, an exemplary embodiment is directed to a system for aligning doors (e.g., doors 200, 300, 400) on an appliance 100, such as a range/stove, in which a first door (e.g., 300) remains stationary or fixed and is not adjustable. A second door (e.g., 200) can be at least one-dimensionally adjustable, for example, in a vertical (up and/or down) direction, as shown by the arrow in FIGS. 1A and 1C. A third door (e.g., 400) can be at least two-dimensionally adjustable, for example, in a vertical (up and/or down) direction and a horizontal (side-to-side) direction, as shown by the arrows in FIGS. 1A-1C.

In other embodiments, the second door (e.g., 200) may be two-dimensionally adjustable in a vertical (up and/or down) direction and a horizontal (side-to-side) direction, and the third door (e.g., 400) may be three-dimensionally adjustable in a vertical (up and/or down) direction, a horizontal (side-to-side) direction, and normal direction (forward and back) with respect to a plane of the other doors, as shown by the arrows in FIGS. 1A-1C. In other embodiments, the second door (e.g., 200) may be one-dimensionally adjustable, and the third door (e.g., 400) can three-dimensionally adjustable.

Figure 2B:
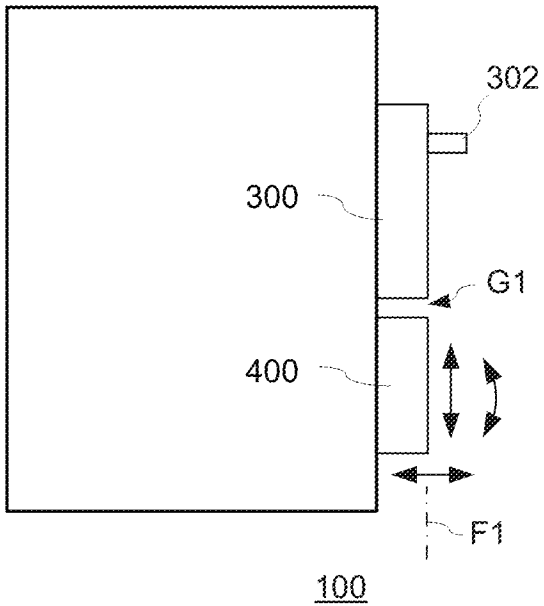
FIGS. 2A and 2B are a schematic, front view and side view, respectively, of a household appliance according to an exemplary embodiment of the invention.
Figure 2A:
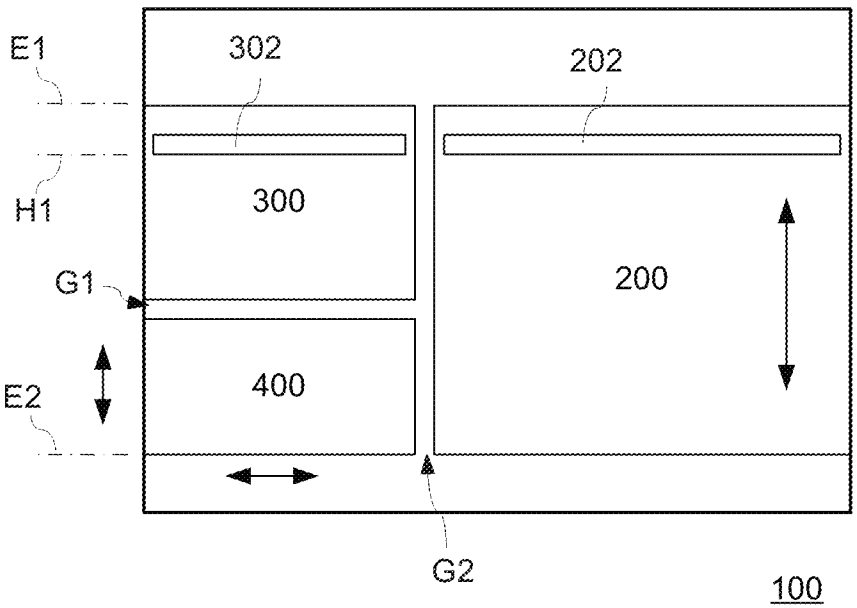

With reference to FIGS. 2A and 2B, an exemplary embodiment of a household appliance 100 includes a non-adjustable first door 300, an adjustable second door 200, and an adjustable third door 400, the non-adjustable first door 300 providing a reference point for adjusting each of the adjustable second door 200 and the adjustable third door 400.

A first adjustment device (not shown) can adjust the adjustable second door 200 in a first vertical direction until one of a handle 202, 302 and a top edge of the non-adjustable first door 300 and the adjustable second door 200 are aligned at a same height (e.g., H1, E1).

A second adjustment device (not shown) can adjust the adjustable third door 400 in a horizontal direction such that a gap (e.g., at G2) between the adjustable third door 400 and the adjustable second door 200 is equal to a gap (e.g., at G2) between the non-adjustable first door 300 and the adjustable second door 200, and adjusts the adjustable third door 400 in the first vertical direction such that the adjustable third door 400 is level and a bottom edge of the adjustable third door 400 is aligned (e.g., at E2) with a bottom edge of the adjustable second door 200 and/or that a gap (e.g., G1) between the adjustable third door 400 and the adjustable first door 300 is constant.

As shown in FIG. 2B, a third adjustment device (not shown) can adjust an angle of a front face of the adjustable third door 400 such that the front face of the adjustable third door 400 is flush with a front face of one of the non-adjustable first door 300 and the adjustable second door 200 (e.g., plane F1).

With reference again to FIG. 2A, the first door 300 and the adjustable third door 400 can be adjacent to a same edge of the adjustable second door 200. In other embodiments, the non-adjustable first door 300 and the adjustable second door 200 can be adjacent to a same edge of the third door 400, or the adjustable second door 200 and the adjustable third door 400 are adjacent to a same edge of the non-adjustable first door 300.

Figure 3:
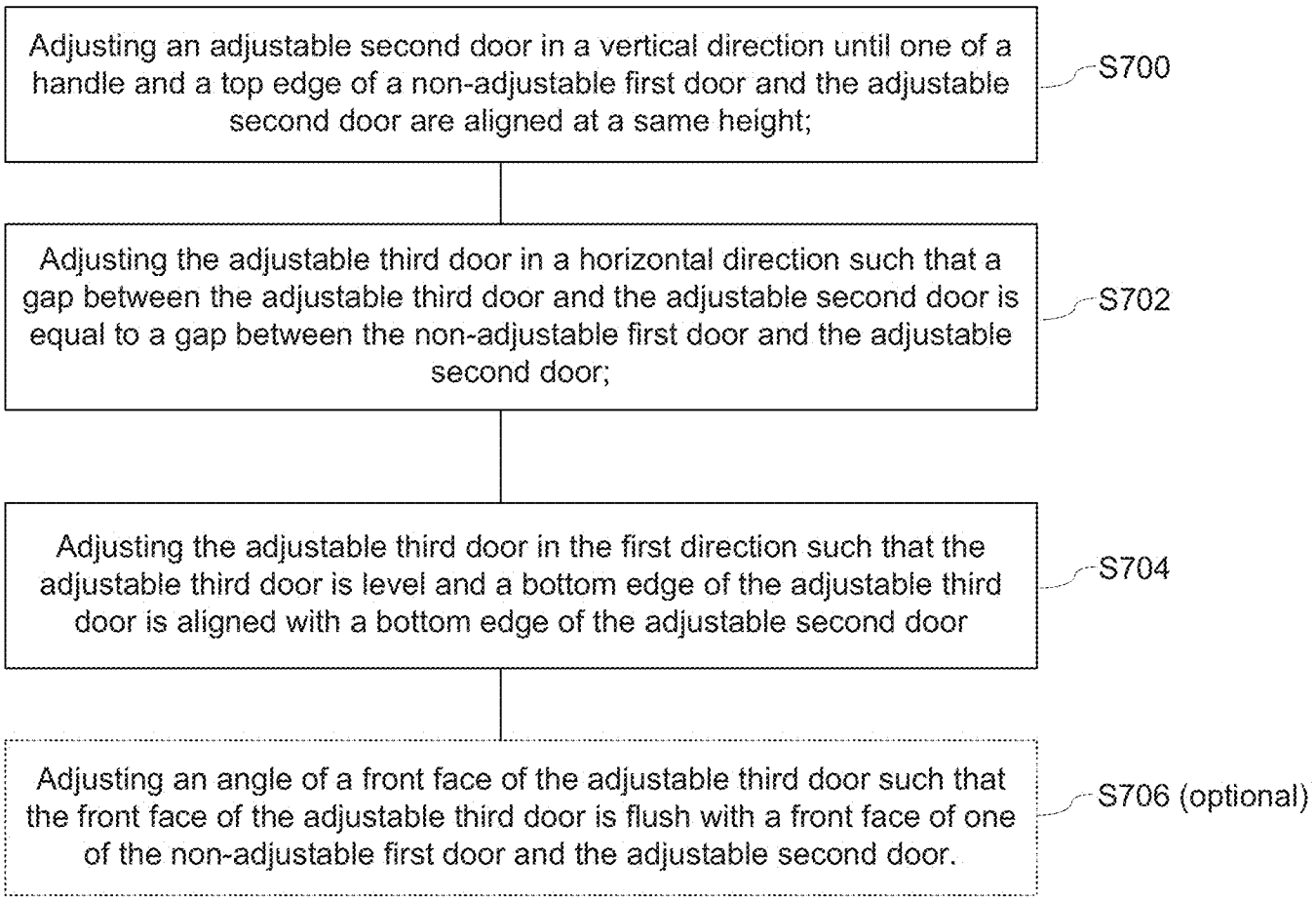
FIG. 3 is a flow diagram of a method according to an exemplary embodiment of the invention.

With reference to FIG. 3, an exemplary method of aligning doors of an appliance will now be described. In the example illustrated, the appliance includes a first door 200 that is disposed adjacent to edges of a second door 300 and a third door 400. The three doors (200, 300, 400) form a generally rectangular overall shape. The first door is non-adjustable and the second and third doors are adjustable in at least one direction and at least two directions, respectively. The non-adjustable first door provides a reference point for adjusting each of the adjustable second door and the adjustable third door, In operation, a user, technician, or installer can adjust the adjustable second door in a vertical direction until one of a handle and a top edge of the non-adjustable first door and the adjustable second door are aligned at a same height (S700). Next, the user, technician, or installer can adjust the adjustable third door in a horizontal direction such that a gap between the adjustable third door and the adjustable second door is equal to a gap between the non-adjustable first door and the adjustable second door (S702). Further, the user, technician, or installer can adjust the adjustable third door in the first direction such that the adjustable third door is level and a bottom edge of the adjustable third door is aligned with a bottom edge of the adjustable second door (S704). In an optional embodiment, the user, technician, or installer can adjust an angle of a front face of the adjustable third door such that the front face of the adjustable third door is flush with a front face of one of the non-adjustable first door and the adjustable second door (S706).

Figure 5:
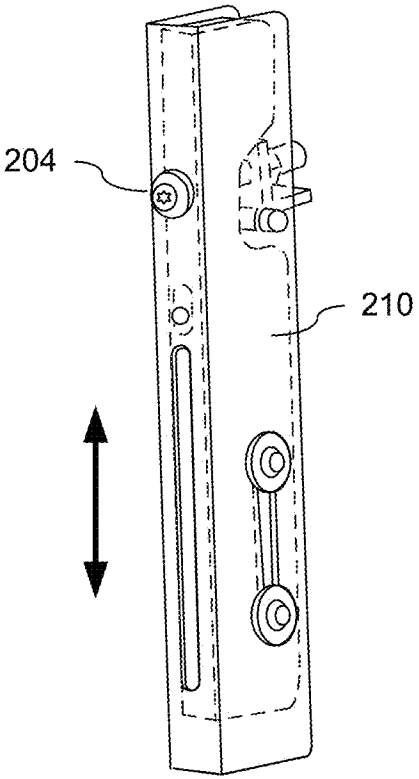
FIG. 5 is a perspective view of a hinge receiver according to an exemplary embodiment of the invention.
Figure 4:
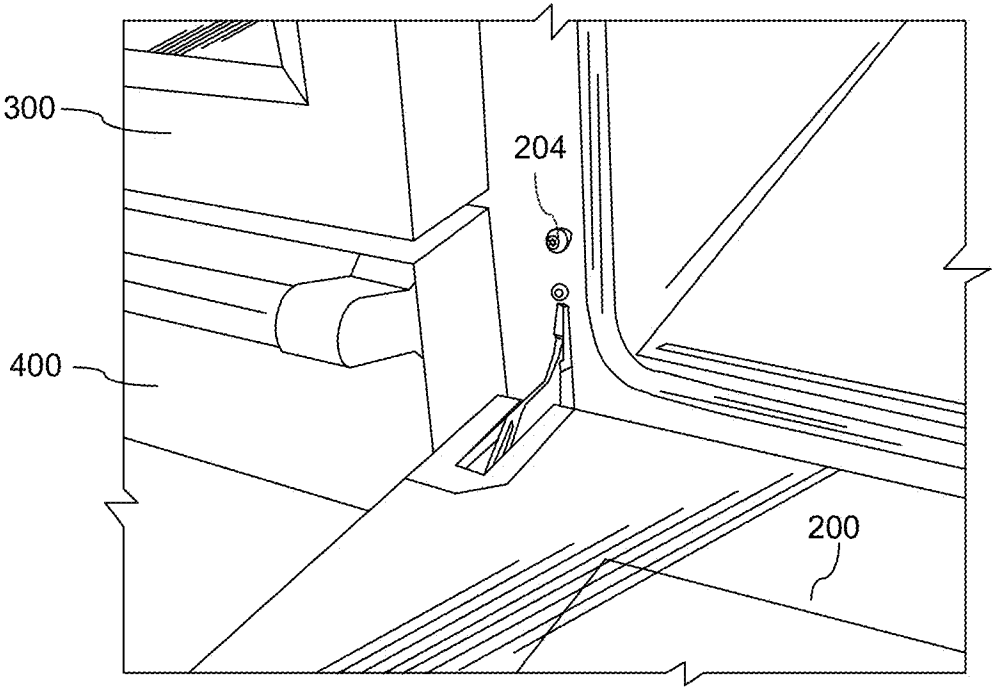
FIG. 4 is a partial perspective view of an appliance having an adjustment screw according to an exemplary embodiment of the invention.

With reference to FIG. 4, in an embodiment, the appliance 100 can include a first adjustment device, such as an adjustable hinge receiver shown in FIG. 5, that adjusts the adjustable second door 200 in the vertical direction using an adjustment screw 204. Conventional hinge receivers may be adjustable by turning an adjustment screw located under the hinge. In contrast, with reference to FIG. 5, the exemplary embodiment can include an inverted adjustable hinge receiver 210 in which the adjustment screw 204 is disposed above a location of the hinge to provide simple and easy access and adjustment of the second door 200. More particularly, the adjustment screw 204 is disposed vertically above a hinge of the adjustable second door 200 such that the adjustment screw 204 is accessible from above the adjustable second door 200 when the adjustable second door 200 is in an open position, as shown in FIG. 4.

Figure 6:
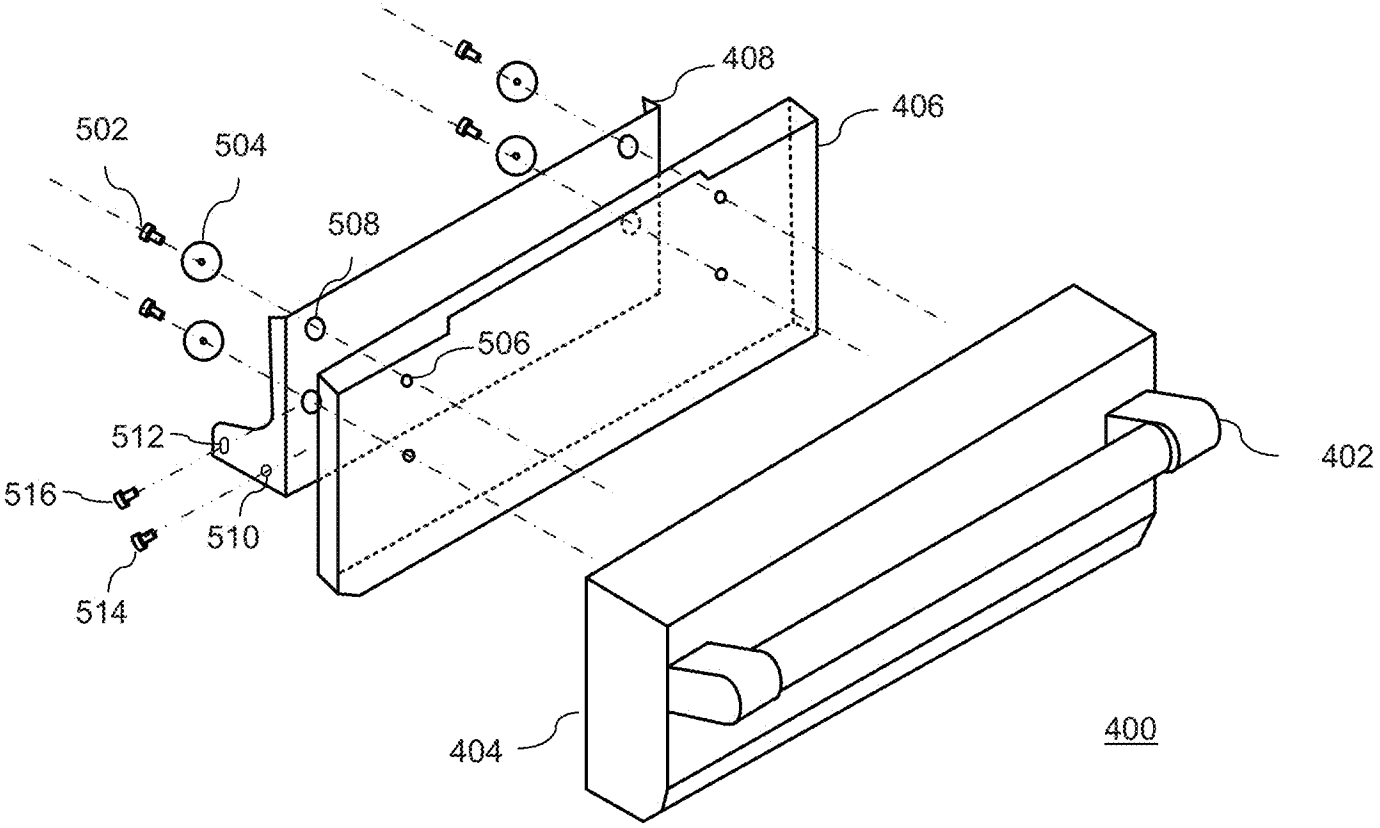
FIG. 6 is an exploded, perspective view of a third door according to an exemplary embodiment of the invention.
Figure 7:
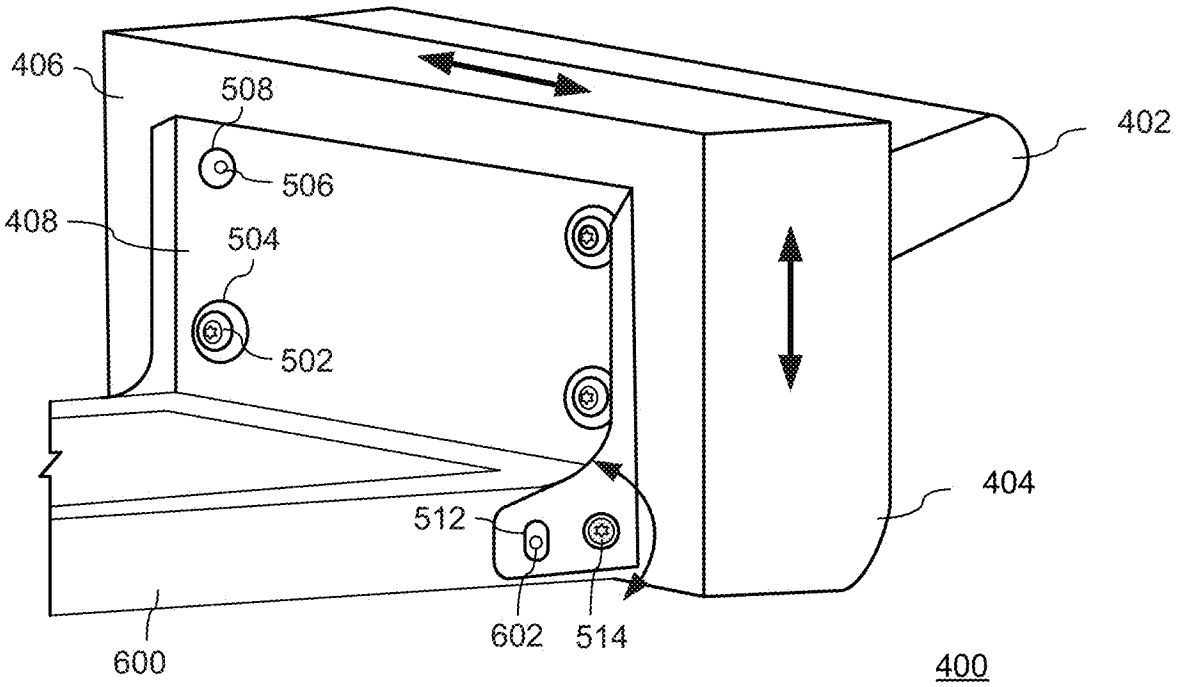
FIG. 7 is a rear, partial perspective view of a third door according to an exemplary embodiment of the invention.

With reference to FIGS. 6 and 7, the third door 400 can include, for example, a front face 404 having handle 402, a mounting plate or rear cover 406 coupled to the front face 404. The rear cover 406 can include a first opening 506 for receiving a fastener 502, a frame 600, and a bracket 408 that couples the rear cover 406 to the frame 600.

The second adjustment device can include the bracket 408 having a second opening 508 corresponding to a location of the first opening 506 of the rear cover 406. The second opening 508 can be configured to be larger than the first opening 506. The fastener 502 can extend through the second opening 508 of the bracket 408 and be secured in the first opening 506 of the rear cover 406. The second adjustment device further can include a washer 504 disposed between an end or head of the fastener 502 and the bracket 408. The washer 504 can be configured to be larger than the second opening 508. For example, the washer can be a fender washer.

With reference again to FIGS. 6 and 7, the third door 400 can include a front face 404 having a handle 402, a rear cover 406 coupled to the front face 404, the rear cover 406 having a first opening 506 for receiving a fastener 502, a frame 600, and a bracket 408 that couples the rear cover 406 to the frame 600. As shown in FIG. 7, the third adjustment device can include a frame opening 602 in the frame 600 and a slotted opening 512 in the bracket 408, wherein the slotted opening 512 corresponds to a location of the frame opening 602. A second fastener (516 shown in FIG. 6) can extend through the slotted opening 512 and be secured in the frame opening 602. With reference again to FIGS. 6 and 7, the third adjustment device further can include a second frame opening (concealed by 514 in FIG. 7) in the frame 600, a pivot fastener opening 510 (shown in FIG. 6) in the bracket 408, and a pivot fastener 514 (shown in FIG. 6) extending through the second frame opening 510 (shown in FIG. 6) and secured in the pivot fastener opening 510 (shown in FIG. 6).

With reference again to FIGS. 1A-2B and 4-7, another exemplary embodiment is directed to an appliance 100 including a non-adjustable first door 300, an adjustable second door 200, and an adjustable third door 400, the non-adjustable first door 300 providing a reference point for adjusting each of the adjustable second door 200 and the adjustable third door 400. The appliance can include first means (e.g., 204 in FIG. 4) for adjusting the adjustable second door 200 in a vertical direction until one of a handle 202, 302 and a top edge (E1 in FIG. 2A) of the non-adjustable first door 300 and the adjustable second door 200 are aligned at a same height. The appliance can include second means (e.g., 502, 504, 506, 508 in FIGS. 6 and 7) for adjusting the adjustable third door 400 in a horizontal direction such that a gap between the adjustable third door 400 and the adjustable second door 200 is equal to a gap G2 between the non-adjustable first door 300 and the adjustable second door 200, and for adjusting the adjustable third door 400 in the first direction such that the adjustable third door 400 is level and a bottom edge of the adjustable third door 400 is aligned (e.g., E2) with a bottom edge of the adjustable second door 200.

With reference again to FIGS. 6 and 7, the means for adjusting the horizontal and vertical position of the third door 400 can include, for example, a plurality of screws (e.g., four (4) screws 502), having washers 504 (e.g., fender washers), disposed in oversized holes (e.g., 508) relative to the screws 502 and the first openings 506 in the mounting plate or rear cover 406 of the third door 400. In this way, the screws 502 can be loosened such that the screws 502 are movable within the oversized holes 508 to permit adjustment of the horizontal and vertical position of the third door 400. The screws 502 then can be tightened in the first openings 506 to secure the washer 504 against the bracket 408 for holding or maintaining the horizontal and vertical position of the third door 400.

With reference again to FIGS. 6 and 7, the appliance 100 can include third means (e.g., 602, 512, 510, 514, 516 in FIGS. 6 and 7) for adjusting an angle of a front face 404 of the adjustable third door 400 such that the front face 404 of the adjustable third door 400 is flush (e.g., in plane F1) with a front face of one of the first door 300 and the adjustable second door 200. For example, the screws or fasteners 514 and 516 can be loosened such that the bracket 408 can pivot about the screw 514 as the screw 516 moves within the slot 512, thereby permitting the assembly of the front face 404, rear cover 406, and bracket 408 to be movable or pivotable with respect to the frame 600 (in FIG. 7). When the front face 404 is flush with a front face of one or both of the non-adjustable first doors 300 and 200, the screws or fasteners 514 and 516 can be tightened to secure the assembly of the front face 404, rear cover 406, and bracket 408 in the desired position with respect to the frame 600, thereby securing the position of the front face 404 with respect to a front face of one or both of the non-adjustable first doors 300 and 200.

The exemplary embodiments can provide a system for, and method of, adjusting a plurality of doors to ensure that all of the doors can be arranged to fit properly relative to one-another. The exemplary embodiments can minimize installation and adjustment time for a user, installer, for example, by minimizing or eliminating unnecessary adjustments that may increase cost and time. The exemplary embodiments can provide a system and method that allows adjustment of all of the doors without special tools and/or without having to remove other components of the appliance.

The present invention has been described herein in terms of several preferred embodiments. However, modifications and additions to these embodiments will become apparent to those of ordinary skill in the art upon a reading of the foregoing description. It is intended that all such modifications and additions comprise a part of the present invention to the extent that they fall within the scope of the several claims appended hereto.

What is claimed is:

1. A household appliance comprising:

a non-adjustable first door, an adjustable second door, and an adjustable third door, the non-adjustable first door providing a reference point for adjusting each of the adjustable second door and the adjustable third door;

a first adjustment device that is configured to adjust the adjustable second door in a vertical direction until one of a handle and a top edge of the non-adjustable first door and the adjustable second door are aligned at a same height; and a second adjustment device that is configured to adjust the adjustable third door in a horizontal direction such that a gap between the adjustable third door and the adjustable second door is equal to a gap between the non-adjustable first door and the adjustable second door; and is configured to adjust the adjustable third door in a first direction such that the adjustable third door is level and a bottom edge of the adjustable third door is aligned with a bottom edge of the adjustable second door, wherein the first adjustment device includes an adjustable hinge receiver that adjusts the adjustable second door in the vertical direction with an adjustment screw, rotation of the adjustment screw resulting in a corresponding movement of the adjustable second door in the vertical direction, and the adjustment screw is accessible for adjustment while the adjustable second door is attached to the first adjustment device.

2. The household appliance of claim 1, further comprising:

a third adjustment device that adjusts an angle of a front face of the adjustable third door such that the front face of the adjustable third door is flush with a front face of one of the non-adjustable first door and the adjustable second door.

3. The household appliance of claim 2, wherein the third door includes:

a front face having the handle;

a rear cover coupled to the front face, the rear cover having a first opening for receiving a fastener;

a frame; and a bracket that couples the rear cover to the frame.

4. The household appliance of claim 3, wherein the third adjustment device includes:

a frame opening in the frame;

a slotted opening in the bracket, the slotted opening corresponding to a location of the frame opening; and a second fastener extending through the slotted opening and secured in the frame opening.

5. The household appliance of claim 4, wherein the third adjustment device further includes:

a second frame opening in the frame;

a pivot fastener opening in the bracket; and a pivot fastener extending through the second frame opening and secured in the pivot fastener opening.

6. The household appliance of claim 1, wherein the non-adjustable first door and the adjustable second door are adjacent to a same edge of the third door.

7. The household appliance of claim 1, wherein the first door and the adjustable third door are adjacent to a same edge of the adjustable second door.

8. The household appliance of claim 1, wherein the adjustable second door and the adjustable third door are adjacent to a same edge of the non-adjustable first door.

9. The household appliance of claim 1, wherein the adjustment screw is disposed vertically above a hinge of the adjustable second door such that the adjustment screw is accessible from above the adjustable second door when the adjustable second door is in an open position.

10. The household appliance of claim 1, wherein the third door includes:

a front face having a first opening for receiving a fastener;

a rear cover coupled to the front face;

a frame; and a bracket that couples the rear cover to the frame.

11. The household appliance of claim 10, wherein the second adjustment device includes:

the rear cover having a second opening corresponding to a location of the first opening, the second opening being larger than the first opening;

the fastener extending through the second opening and being secured in the first opening.

12. The household appliance of claim 11, wherein the second adjustment device further includes:

a washer disposed between an end of the fastener and the rear face, the washer being larger than the second opening.

13. The household appliance of claim 12, wherein the washer is a fender washer.

14. The household appliance of claim 1, wherein the adjustable second door includes a hinge, and wherein the first adjustment device includes an adjustable hinge receiver that receives a portion of the hinge, the adjustable hinge receiver includes the adjustment screw, the adjustment screw is disposed vertically above the hinge of the adjustable second door such that the adjustment screw is accessible from above the adjustable second door when the adjustable second door is in an open position, and the adjustable hinge receiver is configured to adjust the adjustable second door only in the vertical direction.

15. The household appliance of claim 1, wherein the adjustable second door includes a first hinge and a second hinge configured for movement of the adjustable second door with respect to a housing of the household appliance, and wherein the first adjustment device includes a first adjustable hinge receiver coupled to the housing of the household appliance and a second adjustable hinge receiver coupled to the housing of the household appliance, the first adjustable hinge receiver receiving a portion of the first hinge and the second adjustable hinge receiver receiving a portion of the second hinge to secure the door to the housing, each of the first adjustable hinge receiver and the second adjustable hinge receiver having a single one of the adjustment screw disposed vertically above the first hinge and the second hinge, respectively, of the adjustable second door such that the adjustment screw is accessible from above the adjustable second door when the adjustable second door is in an open position, and the first adjustable hinge receiver and the second adjustable hinge receiver are configured to adjust each of the first hinge and the second hinge of the adjustable second door only in the vertical direction.

16. A household appliance comprising:

a non-adjustable first door, an adjustable second door, and an adjustable third door, the non-adjustable first door providing a reference point for adjusting each of the adjustable second door and the adjustable third door;

first means for adjusting the adjustable second door in a vertical direction until one of a handle and a top edge of the non-adjustable first door and the adjustable second door are aligned at a same height;

second means for adjusting the adjustable third door in a horizontal direction such that a gap between the adjustable third door and the adjustable second door is equal to a gap between the non-adjustable first door and the adjustable second door; and for adjusting the adjustable third door in a first direction such that the adjustable third door is level and a bottom edge of the adjustable third door is aligned with a bottom edge of the adjustable second door, wherein the first means for adjusting includes an adjustable hinge receiver that adjusts the adjustable second door in the vertical direction with an adjustment screw, rotation of the adjustment screw resulting in a corresponding movement of the adjustable second door in the vertical direction, and the adjustment screw is accessible for adjustment while the adjustable second door is attached to the first means for adjusting.

17. The household appliance of claim 16, further comprising:

third means for adjusting an angle of a front face of the adjustable third door such that the front face of the adjustable third door is flush with a front face of one of the first door and the adjustable second door.

18. The household appliance of claim 16, wherein the non-adjustable first door and the adjustable second door are adjacent to a same edge of the adjustable third door.

19. The household appliance of claim 16, wherein the non-adjustable first door and the adjustable third door are adjacent to a same edge of the adjustable second door.

20. The household appliance of claim 16, wherein the adjustable second door and the adjustable third door are adjacent to a same edge of the non-adjustable first door.

21. A method of adjusting doors of a household appliance, wherein the household appliance includes the non-adjustable first door, an adjustable second door, and an adjustable third door, the non-adjustable first door being non-adjustable and providing a reference point for adjusting each of the adjustable second door and the adjustable third door, the method comprising:

adjusting the adjustable second door in a vertical direction until one of a handle and a top edge of the non-adjustable first door and the adjustable second door are aligned at a same height;

adjusting the adjustable third door in a horizontal direction such that a gap between the adjustable third door and the adjustable second door is equal to a gap between the non-adjustable first door and the adjustable second door; and adjusting the adjustable third door in a first direction such that the adjustable third door is level and a bottom edge of the adjustable third door is aligned with a bottom edge of the adjustable second door wherein the adjusting of the adjustable second door includes adjusting an adjustment screw that is accessible for adjustment while the adjustable second door is attached to the household appliance, rotation of the adjustment screw resulting in a corresponding movement of the adjustable second door in the vertical direction.

22. The method of 21, further comprising:

adjusting an angle of a front face of the adjustable third door such that the front face of the adjustable third door is flush with a front face of one of the non-adjustable first door and the adjustable second door.

23. The method of 21, wherein the non-adjustable first door and the adjustable second door are adjacent to a same edge of the adjustable third door.

24. The method of 21, wherein the non-adjustable first door and the adjustable third door are adjacent to a same edge of the adjustable second door.

25. The method of 21, wherein the adjustable second door and the adjustable third door are adjacent to a same edge of the non-adjustable first door.

* * * * *